US007297233B2

(12) United States Patent
Herman et al.

(10) Patent No.: US 7,297,233 B2
(45) Date of Patent: Nov. 20, 2007

(54) DEWATERING APPARATUS IN A PAPER MACHINE

(75) Inventors: Jeffrey Herman, Bala Cynwyld, PA (US); Thomas Thoröe Scherb, Sao Paulo (BR); Luiz Carlos Silva, Campo Limpo (BR)

(73) Assignee: Voith Paper Patent GmbH, Heidenheim (DE)

( * ) Notice: Subject to any disclaimer, the term of this patent is extended or adjusted under 35 U.S.C. 154(b) by 486 days.

(21) Appl. No.: 10/768,936

(22) Filed: Jan. 30, 2004

(65) Prior Publication Data

US 2005/0167062 A1 Aug. 4, 2005

(51) Int. Cl.
*D21F 3/02* (2006.01)
*D21F 7/08* (2006.01)

(52) U.S. Cl. ..... 162/358.1; 162/358.2; 162/358.3; 162/358.5; 162/900

(58) Field of Classification Search ..... 162/358.1, 162/358.2, 358.3, 358.4, 204–207, 116, 117, 162/306, 348, 360.3, 359.1, 900–903; 139/383 A, 139/425 A; 442/270, 271; 100/121, 37, 100/151–154; 428/222; 442/286, 320
See application file for complete search history.

(56) References Cited

U.S. PATENT DOCUMENTS

| | | | | |
|---|---|---|---|---|
| 3,293,121 | A * | 12/1966 | Martin | 162/358.3 |
| 3,399,111 | A * | 8/1968 | Beaumont et al. | 162/199 |
| 3,798,121 | A * | 3/1974 | Busker et al. | 162/205 |
| 3,974,026 | A * | 8/1976 | Emson et al. | 162/358.3 |
| 4,427,734 | A | 1/1984 | Johnson | 428/234 |
| 4,464,226 | A * | 8/1984 | Karvinen | 162/358.3 |
| 4,579,771 | A | 4/1986 | Finn et al. | 428/222 |
| 4,772,504 | A * | 9/1988 | Andresen | 428/96 |
| 4,781,795 | A | 11/1988 | Miller | 162/359 |
| 4,948,467 | A * | 8/1990 | Creagan | 162/358.3 |
| 5,114,777 | A * | 5/1992 | Gaisser | 428/137 |
| 5,232,768 | A * | 8/1993 | Eklund et al. | 442/225 |
| 5,342,486 | A * | 8/1994 | Jeffery et al. | 162/358.4 |
| 5,372,876 | A * | 12/1994 | Johnson et al. | 442/271 |
| 5,437,107 | A | 8/1995 | Ensign et al. | 34/117 |
| 6,235,160 | B1 | 5/2001 | Tietz et al. | 162/358.5 |
| 6,274,042 | B1 | 8/2001 | Beck | 210/500.27 |
| 6,350,336 | B1 * | 2/2002 | Paquin | 156/93 |
| 6,416,631 | B1 | 7/2002 | Beck | 162/360.3 |
| 6,436,240 | B1 * | 8/2002 | Jeffrey | 162/358.2 |
| 6,475,343 | B1 | 11/2002 | Grabscheid et al. | 162/207 |
| 6,531,418 | B1 | 3/2003 | Lidar et al. | 442/35 |
| 6,616,812 | B2 * | 9/2003 | Beck | 162/358.2 |
| 6,645,420 | B1 | 11/2003 | Beck | 264/504 |
| 6,712,940 | B2 * | 3/2004 | Crook | 162/306 |
| 6,716,318 | B2 * | 4/2004 | Watanabe | 162/358.2 |
| 6,780,282 | B2 * | 8/2004 | Scherb et al. | 162/111 |

FOREIGN PATENT DOCUMENTS

| | | |
|---|---|---|
| EP | 0 440 076 | 8/1991 |
| GB | 2254288 | * 10/1992 |
| WO | WO 00/34570 | 6/2000 |

* cited by examiner

*Primary Examiner*—Eric Hug
(74) *Attorney, Agent, or Firm*—Taylor & Aust, P.C.

(57) ABSTRACT

A dewatering system in a paper machine includes a dewatering fabric and a press. The dewatering fabric includes a woven permeable fabric and a polymeric layer having openings therethrough, the polymeric layer is connected to the permeable fabric. The press applying pressure to a portion of the dewatering fabric.

13 Claims, 9 Drawing Sheets

| | Felt ($g/m^2$) | Sheet ($g/m^2$) | | Felt ($g/m^2$) | Sheet ($g/m^2$) |
|---|---|---|---|---|---|
| A- | 1200 | 100 | A- | 1200 | 100 |
| B- | --- | --- | B- | 800 | 50 |
| C- | 750 | 35 | C- | 810 | 35 |
| Total Water out of | 450 | 65 | Total Water out of | 390 | 65 |

Sheet basis weight = 14 g/m2 (8.6 lb/rm)

DEWATERING APPARATUS IN A PAPER MACHINE

BACKGROUND OF THE INVENTION

1. Field of the Invention

The present invention relates to a paper machine, and, more particularly, to a method and apparatus for removing water from a fibrous web using a dewatering fabric and a permeable press belt in a paper machine that reduces or eliminates mechanical pressing thus increasing sheet quality.

2. Description of the Related Art

The Voith Paper patented TissueFlex process substitutes a shoe press for the conventional suction pressure roll in a typical Tissue paper machine. The shoe press provides a wider nip that lowers peak pressure, which has shown an increase in sheet caliper and absorbency. These gains are in the 10% to 20% range depending on furnish and overall load. The suction pressure roll is relocated to a position prior to the nip to dewater the press fabric and sheet prior to reaching the shoe press as disclosed in U.S. Pat. No. 6,235,160.

The sheet solids going into the shoe press when running a conventional press fabric on a Crescent former fitted with the TissueFlex process is about 23%. Post shoe press solids are in the 37% to 41% range depending on furnish and overall load.

A fabric is utilized to carry the fiber web during the formation of the web. After the web takes form it is usually subjected to a drying process. The same fabric used during formation of the web or another fabric may come in contact with the web, to move the web across a vacuum section for the remove of moisture from the web. The fabric may additionally absorb moisture from the web and the moisture so absorbed is subsequently removed from the fabric at a later point in the process.

A problem with conventional fabrics is that they carry too much water and rewetting is one of the major issues relative to light basis weight papers, such as tissue. Further, independent of the vacuum applied the sheet solids remain in the 23% to 25% range.

What is needed in the art is a more efficient method of removing water from a fibrous web.

SUMMARY OF THE INVENTION

The present invention provides a combination of a dewatering membrane used in conjunction with a permeable belt press in a paper machine.

The invention comprises, in one form thereof, a dewatering system in a paper machine, the dewatering system including a dewatering fabric and a permeable extended nip press belt. The dewatering fabric includes a woven permeable fabric and a polymeric layer having openings therethrough, the polymeric layer is connected to the permeable fabric. The permeable extended nip press belt applying pressure to a portion of the dewatering fabric.

An advantage of the present invention is that the combination of the dewatering fabric and the permeable extended nip belt enhance the water removal capacity of the dewatering system.

Another advantage is that although a significant tension is applied to the extended nip press belt, the pressure per square inch, as applied to the web, is relatively low.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
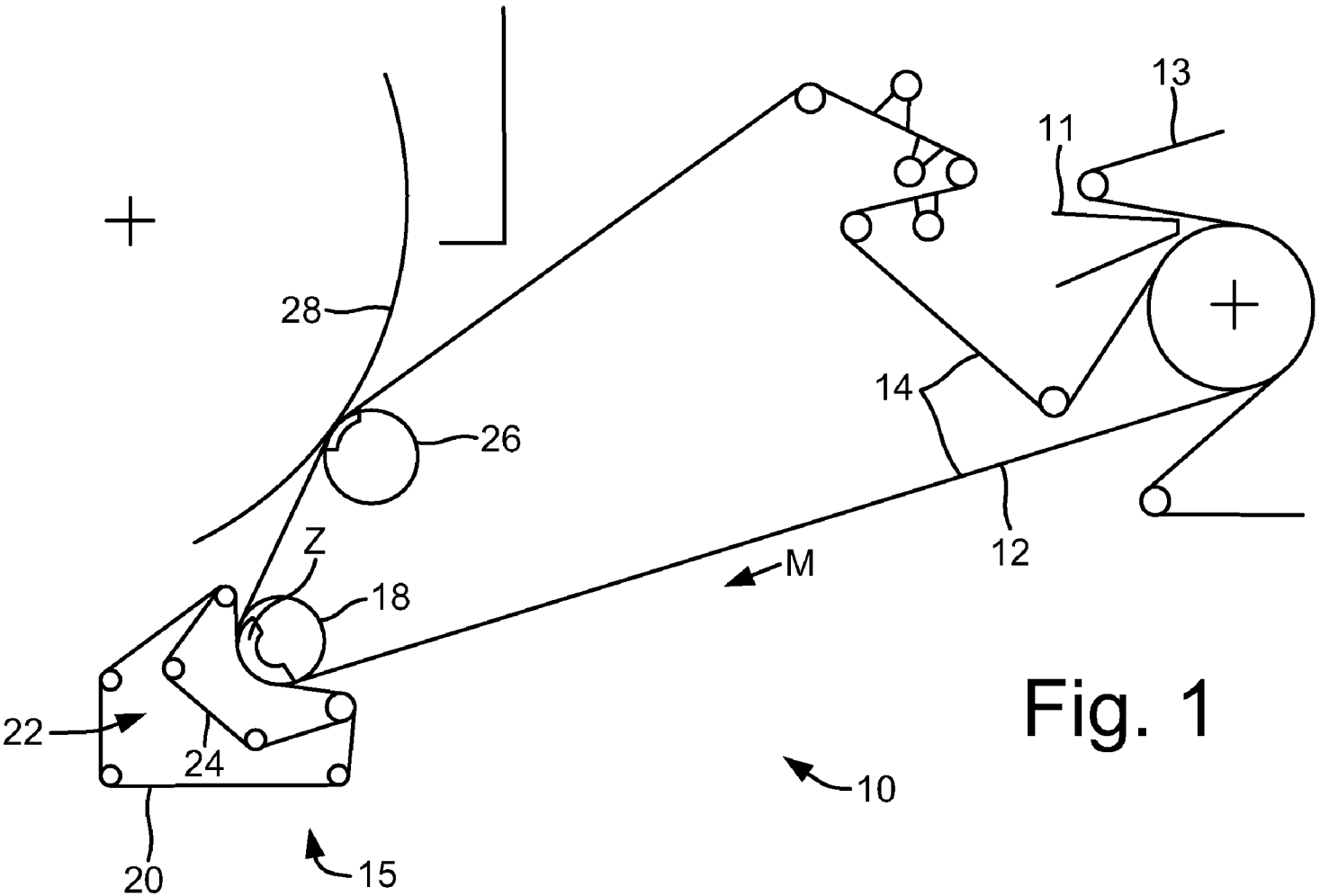
FIG. 1 is a cross-sectional schematic diagram of a paper machine including a dewatering system using at least one of the embodiments of the dewatering fabric and the belt press of the present invention.

Referring now to the drawings, and more particularly to FIG. 1, there is shown a papermaking machine 10, for the processing of fibrous web 12. Headbox 11 provides a fibrous slurry to a nip that is formed by a fabric 13 and a dewatering fabric 14. Moisture is removed through fabric 13 allowing web 12 to form. Web 12 proceeds in machine direction M to dewatering apparatus 15. Dewatering apparatus 15 includes a suction roll 18, an optional fabric 20 and a belt press assembly 22. Belt press assembly 22 includes a fabric 24, which is also known as a belt 24. Web 12 proceeds from dewatering apparatus 15 to shoe press 26, which defines a transfer point with its proximity to Yankee roll 28. At this transfer point web 12 separates from fabric 14 and attaches to the surface of Yankee roll 28, which at least partially dries web 12.

After forming fibrous web 12 proceeds in machine direction M it comes into contact with fabric 20. Web 12 then proceeds toward vacuum roll 18 between dewatering fabric 14 and fabric 20. Fabric 20 is a course mesh fabric. Vacuum roll 18 is operated at a vacuum level to draw moisture from web 12. Fabric 20, web 12 and dewatering fabric 14 are pressed against vacuum roll 18 by belt press assembly 22. A vacuum present in vacuum zone Z pulls a drying fluid, such as air, through permeable belt 24, then through fabric 20, then through web 12 and then through dewatering fabric 14. Moisture collected in vacuum roll 18 is then discharged.

Figure 2:
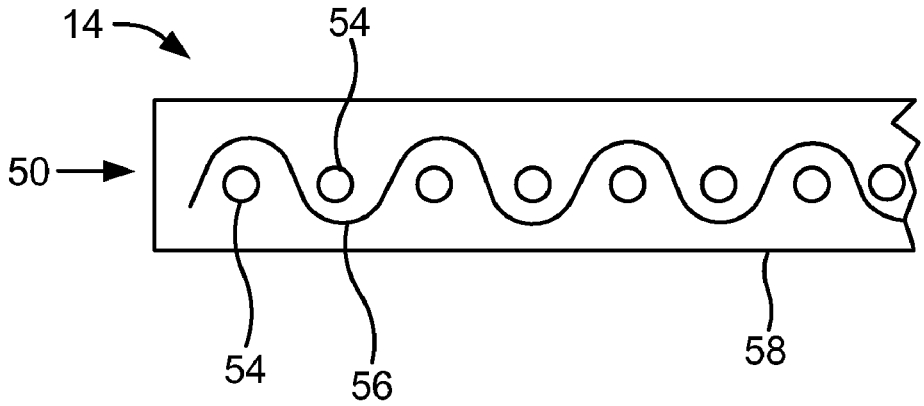
FIG. 2 is a cross-sectional schematic view of an embodiment of a dewatering fabric used in the system of FIG. 1.

Now, additionally referring to FIGS. 2-5, there are shown several embodiments of dewatering fabric 14 of the present invention. In FIG. 2, there is shown fabric 14 having a permeable woven base fabric 50 connected to a batt layer 58. Fabric 50 includes machine direction yarns 54 and cross-directional yarns 56. The cross-sectional area of machine direction yarns 54 is larger than the cross-sectional area of cross-direction yarns 56. Machine direction yarn 54 is a multifilament yarn that may include thousands of fibers. Base fabric 50 is connected to batt layer 58 by a needling process that results in straight through drainage channels therethrough.

Figure 3:
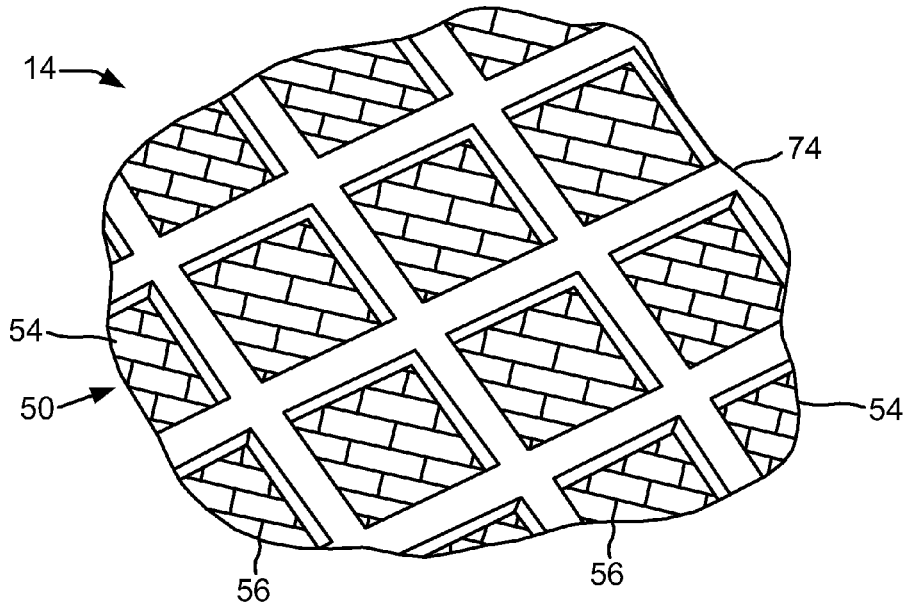
FIG. 3 is a perspective view of yet another embodiment of a dewatering fabric used in the system of FIG. 1.

Now, additionally referring to FIG. 3 there is illustrated another embodiment of dewatering fabric 14. In this embodiment, base fabric 50 has attached thereto a lattice grid 74 made of a polymer, such as polyurethane, that is put on top of base fabric 50. The side of dewatering fabric 14 that runs against a roll is illustrated in FIG. 3. The opposite side of dewatering fabric 14 (not shown), which is an opposite side of base fabric 50, is the side that contacts web 12. Grid 74 may be put on base fabric 50 by utilizing various known procedures, such as, for example, an extrusion technique or a screen-printing technique. As shown in FIG. 3, lattice 74 is put on base fabric 50 with an angular orientation relative to machine direction yarns 54 and cross direction yarns 56. Although this orientation is such that no part of lattice 74 is aligned with machine direction yarns 54 as shown in FIG. 3, other orientations such as that shown in FIG. 4 can also be utilized. Although lattice 74 is shown as a rather uniform grid pattern, this pattern can actually be discontinuous in part. Further, the material between the interconnections of the lattice structure may take a circuitous path rather than being substantially straight, as that shown in FIG. 3. Lattice grid 74 is made of a synthetic, such as a polymer or specifically a polyurethane, which attaches itself to base fabric 50 by its natural adhesion properties.

Lattice grid 74 being a polyurethane has good frictional properties, such that it seats well against the vacuum roll. This then forces vertical airflow and eliminates any x, y plane leakage. The velocity of the air is sufficient to prevent any rewetting once the water makes it through lattice 74.

Additionally, grid 74 may be a thin perforated hydrophobic film 74 having an air permeability of 35 cfm or less, preferably 25 cfm or less having pores therein of approximately 15 microns. Here too we have vertical airflow at high velocity to prevent rewet.

Figure 4:
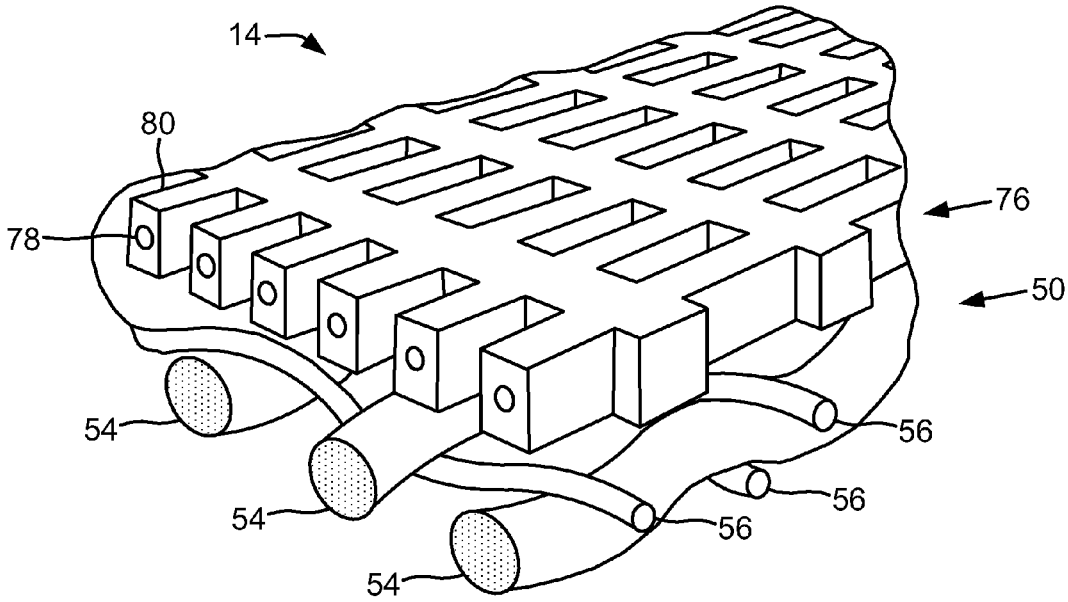
FIG. 4 is a sectioned perspective view of yet another embodiment of a dewatering fabric used in the system of FIG. 1.

Now, additionally referring to FIG. 4, which illustrates the vacuum roll contacting side of dewatering fabric 14. This is yet another embodiment of dewatering fabric 14 that includes permeable base fabric 50 having machine direction multifilament yarns 54 and cross-direction monofilament yarns 56, that are adhered to grid 76, also known as an anti-rewet layer 76. Grid 76 is made of a composite material, which may be an elastomeric material the may be the same as that used in lattice grid 74. Grid 76 includes machine direction yarns 78 and a composite material 80 formed therearound. Grid 76 is a composite structure formed of elastomeric material 80, and machine direction yarn 78. Machine direction yarn 78 may be pre-coated with elastomeric material 80 before being placed in rows that are substantially parallel in a mold that is used to reheat elastomeric material 80 causing it to re-flow into the pattern shown as grid 76 in FIG. 4. Additional elastomeric material 80 may be put into the mold as well. Grid structure 76, also known as composite layer 76, is then connected to base fabric 50 by one of many techniques including laminating grid 76 to permeable fabric 50, melting elastomeric coated yarn 78 as it is held in position against permeable fabric 50 or by re-melting grid 76 onto base fabric 50. Additionally, an adhesive may be utilized to attach grid 76 to permeable fabric 50. Composite layer 76 seals well against the vacuum roll preventing x, y plane leakage and allowing vertical airflow to prevent rewet.

Figure 5:
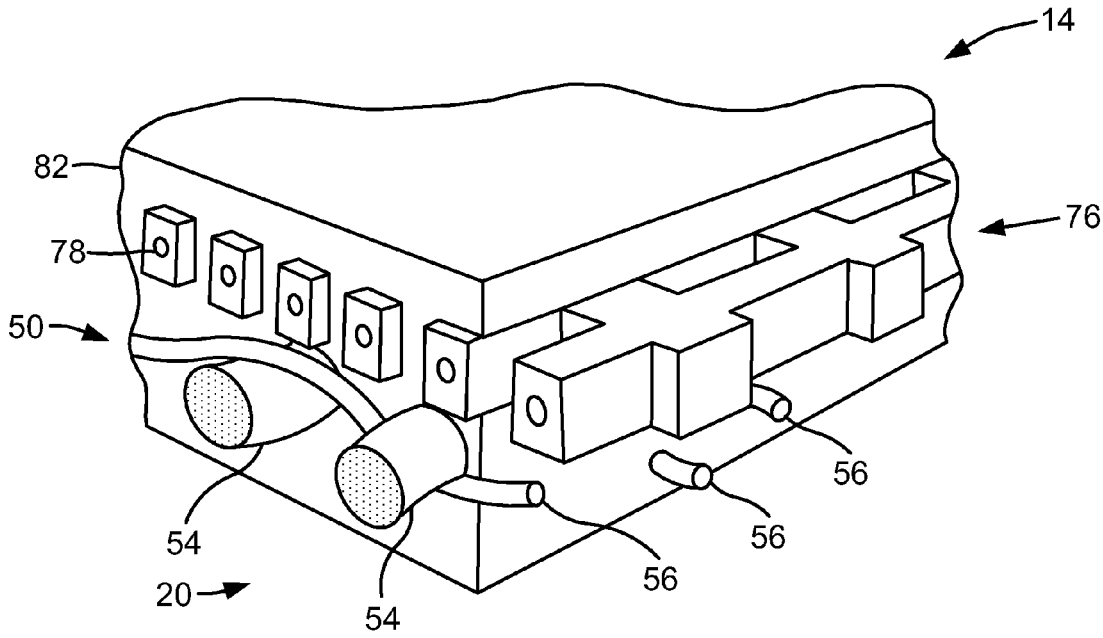
FIG. 5 is a sectioned perspective view of still yet another embodiment of a dewatering fabric used in the system of FIG. 1.
Figure 6:
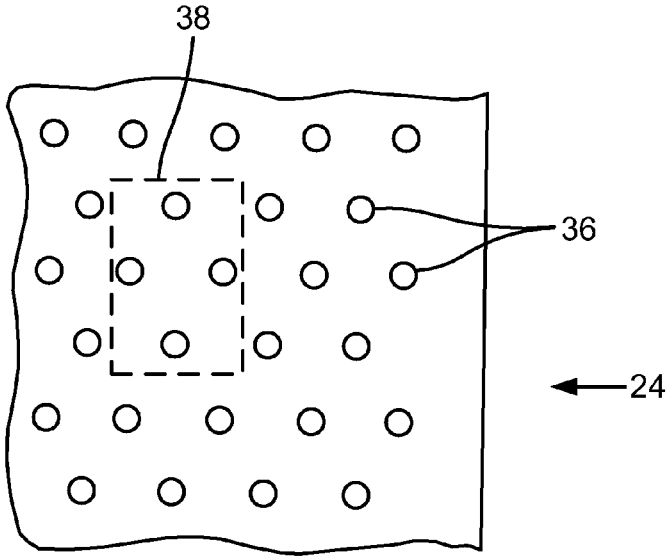
FIG. 6 is a surface view of one side of a permeable belt of the belt press of FIG. 1.
Figure 7:
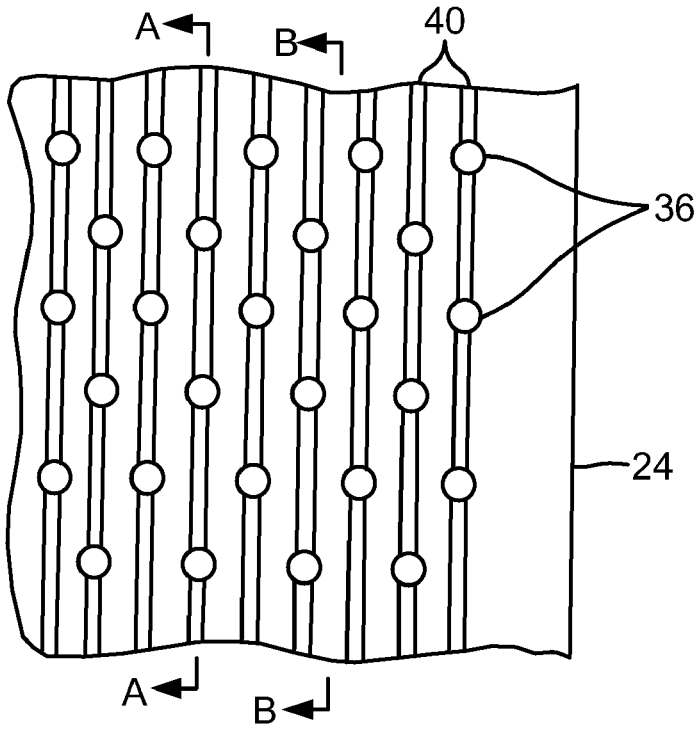
FIG. 7 is a view of an opposite side of the permeable belt of FIG. 6.
Figure 8:
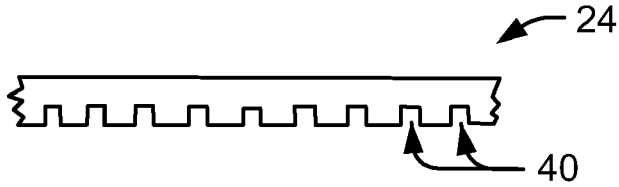
FIG. 8 is cross-sectional view of the permeable belt of FIGS. 6 and 7.
Figure 9:
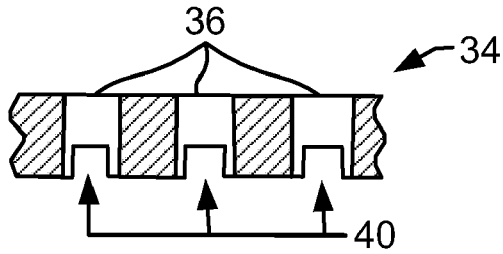
FIG. 9 is an enlarged cross-sectional view of the permeable belt of FIGS. 6-8.

Now, additionally referring to FIG. 5, which illustrates the roll side of dewatering fabric 14. This structure includes the elements that are shown in FIG. 4 with the addition of batt fiber 82. Batt fiber 82 is needled into the structure shown in FIG. 4 to mechanically bind the two layers together, thereby forming a dewatering fabric 14 having a smooth needled batt fiber surface. Batt material 82 is porous by its nature, additionally the needling process not only connects the layers together, it also creates numerous small porous cavities extending into or completely through the structure of dewatering fabric 14.

Dewatering fabric 14 has an air permeability of from 5 to 100 cubic feet/minute preferably 19 cubic feet/minute or higher and more preferably 35 cubic feet/minute or higher. Mean pore diameters, as measured using a Coulter method, are from 5 to 75 microns, preferably 25 microns or higher and more preferably 35 microns or higher. Either surface of dewatering fabric 14 can be treated with a material to make it hydrophobic. Lattice composite layer 76 may be made of a synthetic polymeric material or a polyamide that is laminated to fabric 50.

Batt fiber layers are made from fibers ranging from 0.5 d-tex to 22 d-tex and may contain an adhesive to supplement fiber to fiber bonding in each of the layers. The bonding may result, for example, from a low temperature meltable fiber, particles and/or resin. The layers of dewatering fabric 14, when combined are less than 2.0 millimeters thick, preferably less than 1.50 millimeters, and more preferably less than 1.25 millimeters and even more preferably less than 1.0 millimeter thick.

Machine direction yarns 54, shown in FIGS. 3, 4 and 5, also known as weft yarns 54 in an endless weaving process, are made of a multi-filament yarn, normally twisted/plied or can be a solid monolithic strand usually of less than 0.40 millimeter diameter, with a preferable diameter of 0.20 millimeter or as low as 0.10 millimeter. Cross direction yarns 56, shown in FIGS. 3, 4 and 5, also known as warp yarns 56 when woven in an endless weaving process are made of a monofilament yarn, of a diameter greater than or equal to 0.2 mm, preferably 0.38 mm. The multifilament yarns are formed in a single strand, twisted cabled or joined side by side to form a flat shaped fabric 50. Woven permeable fabric 50 may have straight through channels needled through fabric 50, thereby causing a straight through drainage channel through dewatering fabric 14. Additionally, a hydrophobic layer may be applied to at least one surface.

As to the uses of dewatering fabric 14 in papermaking machine 10, web 12 continues with fabric 14 from its formation until it encounters Yankee roll 28, where web 12 separates from fabric 14. At drying apparatus 15 gentle pressure is applied by belt press 22 against web 12 as a mechanical force that helps to accelerate the moisture removal from web 12. The squeezing action is coupled with a vacuum at zone Z of vacuum roll 18, to drive moisture from web 12 and through dewatering permeable membrane 14. Advantageously, moisture is removed through the combination of the pressure applied by the extended nip press contact of belt 24 and the introduction of air through belt 24 and fabrics 14 and 20 enhance the dewatering capability of the present invention.

Now, additionally referring to FIGS. 6-9 there are shown details of permeable belt 24 of belt press 22 having holes 36 therethrough, holes 36 are arranged in a hole pattern 38 and grooves 40 are located on one side of belt 24. Permeable belt 24 is routed so as to engage a surface of dewatering fabric 14 and thereby press dewatering fabric 14 further against web 12, and web 12 against dewatering fabric 14, which is supported thereunder by vacuum roll 18. As this temporary coupling around vacuum roll 18 continues in machine direction M, it encounters a vacuum zone Z causing air to be passed through permeable belt 24, dewatering fabric 14, drying web 12 and the moisture picked up by the airflow proceeds further through dewatering fabric 14 and through a porous surface of vacuum roll 18. There is a low pressing load applied to web 12 over the extended nip as air flows through belt 24, web 12, fabric 14 and roll 18.

Permeable belt 24, used in belt press 22, may be an extended nip press belt made of a flexible reinforced polyurethane. The advantage of a flexible reinforced polyurethane belt is that it provides a low level of pressing in the range of 50-300 KPa and preferably greater than 100 KPa. This allows a suction roll with a 1.2 meter diameter to work in concert with belt 24 having a tension of greater than 30 KN/m and preferably greater than 60 KN/m. The pressing length of permeable belt 24 against dewatering fabric 14, which is indirectly supported by vacuum roll 18, is at least as long as suction zone Z in roll 18. Although the contact portion of permeable belt 24 can be shorter than suction zone Z. Even though significant tension can be applied to belt 24, since there is a large interface area of belt 24 with roll 18, the pressure per square centimeter is low so that compression on web 12 is minimized. Further if fabric 14 has a structure associated therewith, significant portions of web 12 will lie in valleys and may not receive any mechanical compression at all.

Permeable belt 24 has a pattern 38 of holes 36 therethrough, which may, for example, be drilled, laser cut, etched formed or woven therein. Permeable belt 24 may be monoplanar without the grooves shown in FIGS. 7-9. In one embodiment of the present invention, the surface having grooves 40 as shown in FIG. 3 is placed in contact with fabric 20 along a portion of the travel of permeable belt 24 in belt press 22. Each groove 40 connects with a set of holes 36 to allow the passage and distribution of air in belt 24. Air is distributed along grooves 40, which constitutes an open area adjacent to contact areas, where the surface of belt 24 applies pressure against web 12. Air enters permeable belt 24 through holes 36 and then migrates along grooves 40 passing through fabric 20, web 12 and dewatering fabric 14. The diameter of holes 36 is larger than the width of grooves 40. Although grooves 40 are shown having a generally rectangular cross-sectional, grooves 40 may have a different cross-section contour, such as, triangular, trapezoidal, semi-circular or semi-elliptical. The combination of permeable belt 24, associated with vacuum roll 18, is a combination that has been shown to increase sheet solids by at least 15%.

Permeable belt 24 is capable of running at high running tensions of at least 30 KN/m or 60 KN/m or higher with a relatively high surface contact area of 25% or greater and a high open area of 25% or greater. The composition of permeable belt 24 may include a thin spiral link having a support layer within permeable belt 24. Alternatively, belt 24 may be a link fabric and fabric 20 may be eliminated, allowing link fabric 24 to both encounter web 12 and to pass drying air therethrough.

Figure 11:
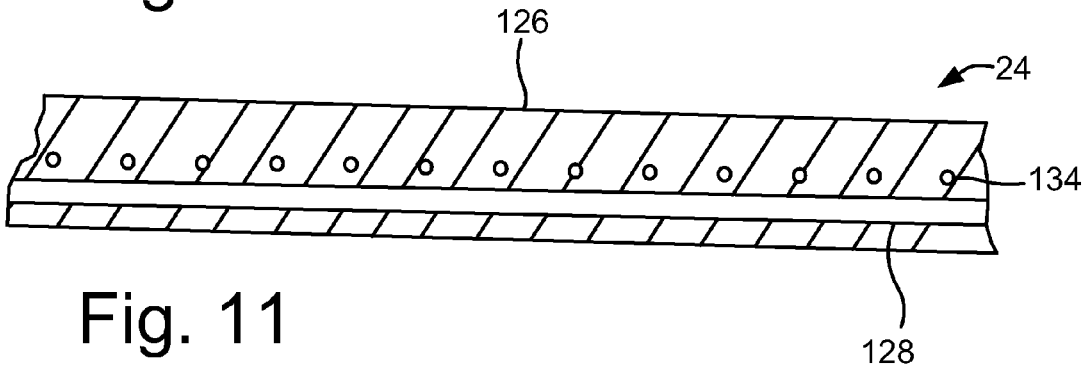
FIG. 11 is another cross-sectional view of the permeable belt of FIG. 7, taken along B-B of FIG. 7.
Figure 10:
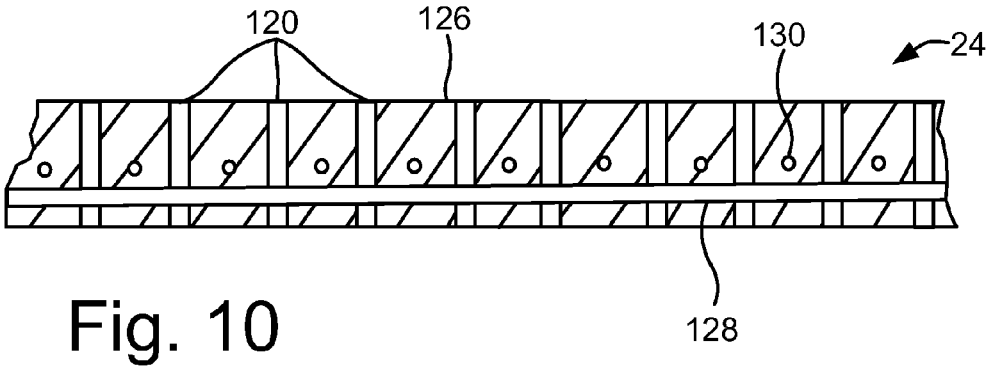
FIG. 10 is a cross-sectional view of the permeable belt of FIG. 7, taken along A-A of FIG. 7.

In one embodiment of permeable belt 24, as illustrated in FIGS. 10 and 11, a polyurethane matrix 126 has a permeable structure in the form of a woven structure with reinforcing machine direction yarns 128 and cross direction yarns 130 at least partially embedded within polyurethane matrix 126.

Figure 13:
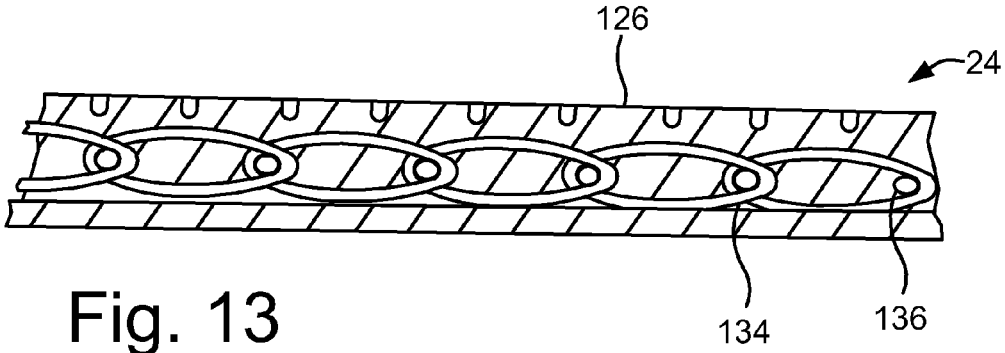
FIG. 13 is a cross-sectional view of another embodiment of the permeable belt of FIG. 7, taken along B-B of FIG. 7.
Figure 12:
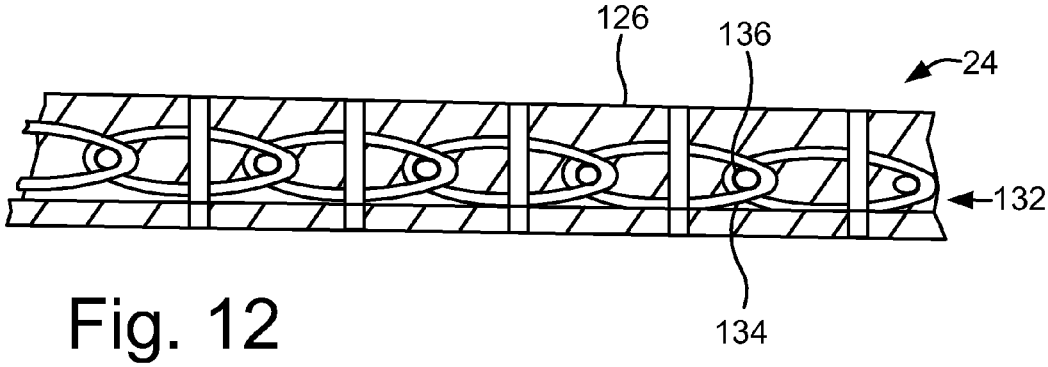
FIG. 12 is a cross-sectional view of another embodiment of the permeable belt of FIG. 7, taken along A-A of FIG. 7.

In another embodiment of permeable belt 24, as illustrated in FIGS. 12 and 13, a polyurethane matrix 126 has a permeable structure in the form of a spiral link fabric 132 at least partially embedded within polyurethane matrix 126. Holes 120 extend through belt 24 and may at least partially sever portions of spiral link fabric 132.

Figure 14:
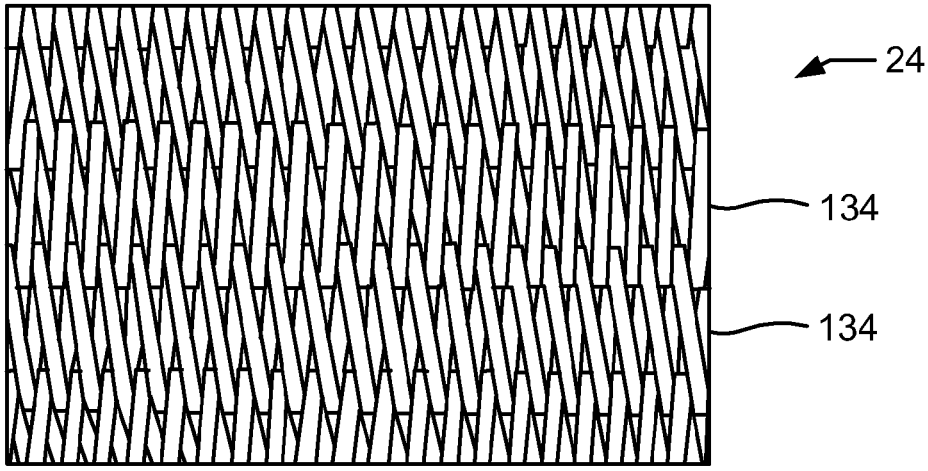
FIG. 14 is a surface view of another embodiment of the permeable belt of the present invention.
Figure 15:
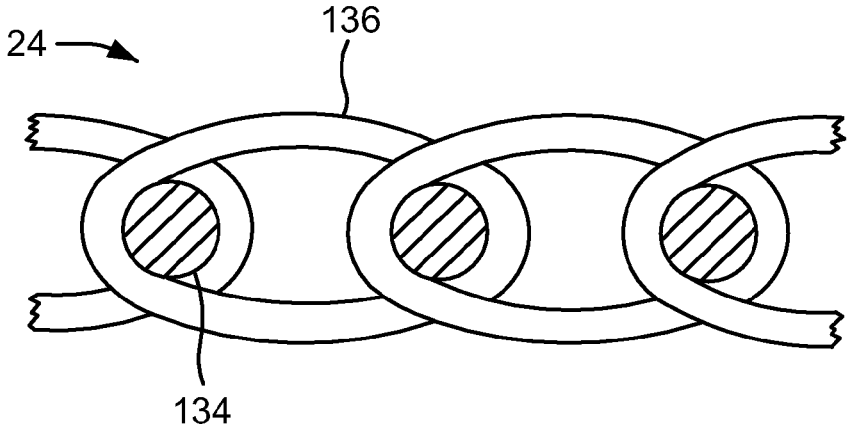
FIG. 15 is a side view of a portion of the permeable belt of FIG. 14.

In yet another embodiment of permeable belt 24, as illustrated in FIGS. 14 and 15, yarns 134 are interlinked by the entwining of generally spiral woven yarns 134 with cross yarns 136 to form link fabric 132.

Permeable belt 24 is capable of applying a line force over an extremely long nip, thereby ensuring a long dwell time in which pressure is applied against web 12 as compared to a standard shoe press. There is a simultaneous airflow while web 12 is passing through the long nip. This results in a much lower specific pressure, thereby reducing the sheet compaction and enhancing sheet quality. The present invention further allows for a simultaneous vacuum and pressing dewatering with airflow through the web at the nip itself.

Advanced dewatering system 15 utilizes belt press 22 to remove water from web 12, which is formed prior to reaching belt press 22. Permeable belt 24 is routed in belt press 22 so as to engage a surface of fabric 20 and thereby press fabric 20 further against web 12, and web 12 against dewatering fabric 14, which is supported thereunder by vacuum roll 18. As this coupling of web 12 with fabrics 14 and 20, and belt 24 continues around vacuum roll 18 in machine direction M, it encounters a vacuum zone Z by which air is drawn through permeable belt 24, dewatering fabric 14, drying web 12 and the moisture picked up by the air flow proceeds further through dewatering fabric 14 and through a porous surface of vacuum roll 18. Drying air passes through holes 36 is distributed along grooves 40 before passing through dewatering fabric 14. As web 12 leaves belt press 22, belt 24 and fabric 20 separate from web 12.

Figure 16:
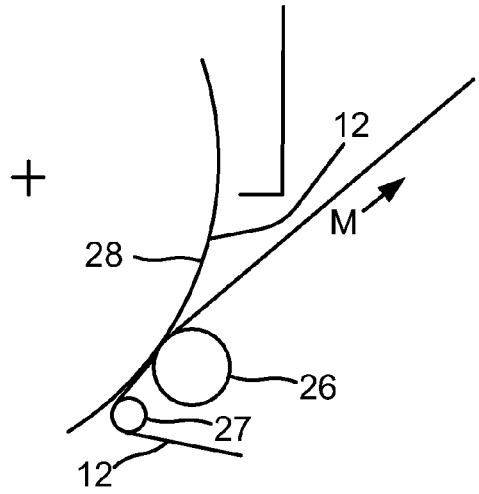
FIG. 16 is a cross-sectional schematic diagram of an embodiment of a portion of the paper machine of FIG. 1.
Figure 17:
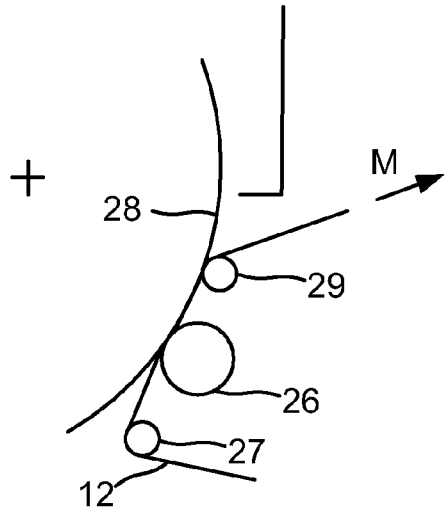
FIG. 17 is a cross-sectional schematic diagram of another embodiment of a portion of the paper machine of FIG. 1.
Figure 18:
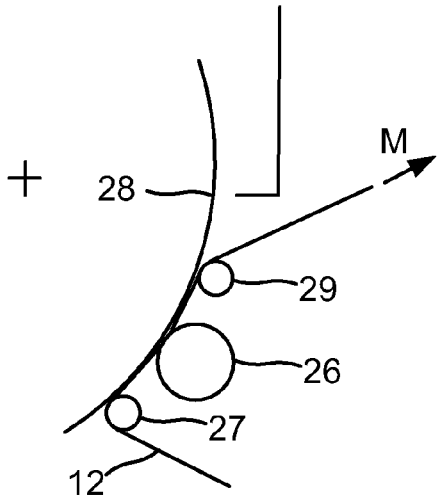
FIG. 18 is a cross-sectional schematic diagram of another embodiment of a portion of the paper machine of FIG. 1.
Figure 19:
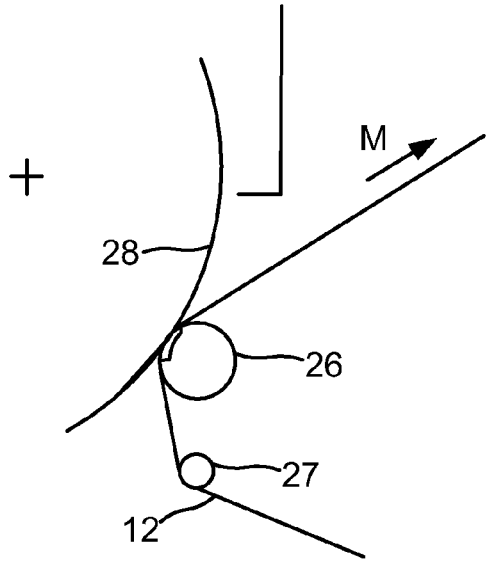
FIG. 19 is a cross-sectional schematic diagram of still another embodiment of a portion of the paper machine of FIG. 1.

Web 12 proceeds from dewatering apparatus 15 to transfer device 26 and Yankee 28. Transfer device 26 may be in the form of a shoe press 26 as illustrated in FIG. 1, a suction press roll, a solid press roll or a drilled press roll. Now additionally referring to FIGS. 16-19, there are shown alternatives ways in which transfer device 26 may be embodied in which the nip is lengthened. In FIG. 16, a roll 27 precedes roll 26, in machine direction M, and is arranged to cause web 12 to contact Yankee roll 28 prior to roll 26. In FIG. 17, roll 27 precedes roll 26 and roll 29 follows roll 26, in machine direction M, with roll 29 arranged to cause web 12 to contact Yankee roll 28 at and subsequent to roll 26. In FIG. 18, roll 27 precedes roll 26 and roll 29 follows roll 26, in machine direction M, with rolls 27 and 29 arranged to cause web 12 to contact Yankee roll 28 prior to and subsequent to roll 26. In FIG. 19, roll 27 precedes roll 26, in machine direction M, and roll 26 is a shoe press causing web 12 to contact Yankee roll 28. In each case reduced pressure is used in contacting web 12 with Yankee 28 than in conventional paper machines, because the solids in web 12 are high enough that less pressing is required. This advantageously allows less compaction of web 12 thereby enhancing quality, strength and absorbency of web 12. A benefit of the present invention is that the caliper and absorbency of the web produced is increased by 25% to 35% over that produced by conventional technology.

The dewatering that occurs at dewatering apparatus 15 presents a web 12 to Yankee 28 having sheet solids of greater than 30%, preferably greater than 35% and more preferably greater than 40%. This greatly reduces the need for additional mechanical pressing at Yankee 28.

The present invention may be applied to other configurations, for example a suction breast roll machine, a twin wire or a Fourdrinier machine. A shoe press may be optionally utilized. If a shoe press is used it will require an additional dewatering apparatus, such as a vacuum turning roll or a multi-slot vacuum box prior to the pressure roll nip at Yankee 28. The paper web is formed, for example on a Crescent Former between an inner and an outer fabric. The outer fabric can be a conventional or a drainage fabric having differing zonal drainage characteristics. The inner fabric is dewatering fabric 14. Web 12 is carried by fabric 14 to and around suction roll 18 whereby the dryness of web 12 is increased from about 12% to 23% or higher than 30%. Press apparatus 22 enhances the dewatering effect. The wrapping angle of fabric 14 around roll 18 can be greater or smaller than vacuum zone Z. A pressure is applied by belt 24 to web 12 and fabric 14. Fabric 20 is optionally present to prevent web 12 from following belt 24.

After web 12 passes from dewatering apparatus 15, web 12 is carried to a press nip between Yankee 28 and shoe press 26. Shoe press 26 preferably has a shoe width of 80 mm or higher, preferably 120 mm or higher. A maximum peak pressure applied in the length of contact is less that 1.5 MPa, preferably less than 1.0 MPa, and more preferably less than 0.5 MPa. The solids content of web 12 as it enters the Yankee nip is preferably greater than 30%, more preferably greater than 35%, and even more preferably greater than 40%. This eliminates or greatly reduces the need for additional mechanical pressing at the Yankee. With substantially less pressing, the dewatering structures can be less robust than prior art structures an still provide acceptably acceptable service.

Figure 20A:
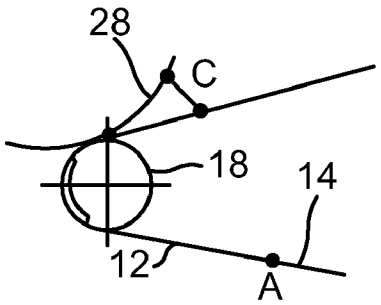
FIG. 20A illustrates an embodiment of the present invention and the moisture content of the fabric and web at various stages.

Now, additionally referring to FIG. 20A there is shown vacuum roll 18 also known as a suction press roll 18 and a Yankee 28. Dewatering fabric 14 carries web 12 as water is removed from web 12. At position A the water content of fabric 14, also known as felt 14 is 1,200 g/m$^2$ and the water content of web 12 also known as sheet 12 is 100 g/m$^2$. At point C after web 12 is transferred to Yankee 28 the water content of felt 14 is 750 g/m$^2$ and the water content of sheet 12 is 35 g/m$^2$.

Figure 20B:
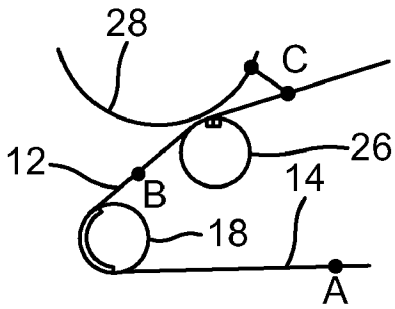
FIG. 20B illustrates an embodiment of the TissueFlex process and the moisture content of the fabric and web at various stages.

Now, additionally referring to FIG. 20B there is shown vacuum roll 18, shoe press 26 and Yankee 28. Dewatering fabric 14 carries web 12 as water is removed from web 12. At position A the water content of fabric 14, also known as felt 14 is 1,200 g/m$^2$ and the water content of web 12 also known as sheet 12 is 100 g/m$^2$. At point B the water content of felt 14 is 800 g/m$^2$ and the water content of sheet 12 is 50 g/m$^2$. At point C after web 12 is transferred to Yankee 28 the water content of felt 14 is 810 g/m$^2$ and the water content of sheet 12 is 35 g/m$^2$.

The press fabric strategy for this process as well as other Tissue processes is to provide a fabric 14 for carrying web 12 that is robust enough to withstand repeated compactions in a press nip to thereby provide adequate life of fabric 14. This has translated into a state of the art press fabric that typically carries around 1,200 g/m$^2$ of water when saturated. The TissueFlex process, see U.S. Pat. No. 6,235,160, partially illustrated in FIG. 20B has separated a suctioning effect from the pressing effect. During the first dewatering process, the press fabric loses up to 400 g/m$^2$ of water and the sheet loses up to 50 g/m$^2$ resulting in web 12 having approximately 23% solids. During mechanical pressing in shoe press 26 web 12 will lose another 15 g/m$^2$, which is absorbed into the fabric 14. Comparing this with a standard Crescent former (FIG. 20A without TissueFlex, fabric 14 and web 12 simultaneously lose 450 g/m$^2$ and 65 g/m$^2$ respectively).

The ratio of water still in fabric 14 remaining post press is disproportional to the water remaining in web 12, approximately 20:1 for a conventional Crescent former and for a Crescent former retrofitted to the TissueFlex process. It has been shown that by either reducing residual fabric water in the press fabric or minimizing the rewetting effect with the dewatering fabric of the present invention that sheet solids can increase above 23%, which in turn can yield a dryer sheet after pressing.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dewatering system in a paper machine, the dewatering system comprising:

a dewatering fabric, including:

a woven permeable fabric; and a polymeric layer having openings therethrough, said polymeric layer connected to said permeable fabric; and a press apparatus applying pressure to a portion of said dewatering fabric;

an other fabric; and a vacuum roll in at least partial contact with a side of said dewatering fabric, said dewatering fabric carrying a web on one side thereof, a side of said other fabric contacting a side of the web, said press apparatus applying pressure to a portion of an other side of said other fabric; said press apparatus being a belt press.

2. The system of claim 1, wherein said dewatering fabric further includes at least one batt layer needled to said permeable fabric and said polymeric layer, thereby connecting said permeable fabric and said polymeric layer.

3. The system of claim 2, wherein said at least one batt layer includes a first batt layer and a second batt layer, said first batt layer adjacent said permeable fabric, said second batt layer adjacent said polymeric layer, said first batt layer and said second batt layer needled to said permeable fabric and said polymeric layer.

4. The system of claim 1, wherein said polymeric layer is a flexible polyurethane.

5. The system of claim 1, wherein said polymeric layer is a grid of polymeric material, said grid having a plurality of machine direction runs and a plurality of cross direction runs.

6. The system of claim 5, wherein said dewatering fabric further includes a plurality of yams combined with said grid of polymeric material, thereby forming a composite layer, at least one of said yarns internal to each of a corresponding one of said plurality of machine direction runs.

7. The system of claim 6, wherein said dewatering fabric further includes at least one batt layer needled to said permeable fabric and said composite layer, thereby connecting said permeable fabric and said composite layer.

8. The system of claim 1, wherein said polymeric layer is connected to said permeable fabric by at least one of laminating, melting, re-melting and an adhesive.

9. The system of claim 1, wherein said polymeric layer includes a plurality of yams within said polymeric layer.

10. The system of claim 1, wherein said press includes an extended nip press belt in contact with said portion of said other side of said other fabric.

11. The system of claim 10, wherein said extended nip press belt includes a plurality of grooves.

12. The system of claim 11, wherein said extended nip belt additionally includes a plurality of holes drilled therethrough, said plurality of holes in fluid communication with at least one corresponding groove.

13. The system of claim 1, wherein said vacuum roll has a vacuum zone by which air is drawn through said other fabric, said web and said dewatering fabric.

* * * * *